US009970292B2

(12) United States Patent
Wilson et al.

(10) Patent No.: US 9,970,292 B2
(45) Date of Patent: May 15, 2018

(54) DRILLING APPARATUS

(71) Applicant: J.H. FLETCHER & CO., Huntington, WV (US)

(72) Inventors: Henry Eugene Wilson, Ironton, OH (US); Robert Dean Burgess, Huntington, WV (US); William G. Kendall, Chesapeake, OH (US); Robert Anderson, Culloden, WV (US)

(73) Assignee: J.H. Fletcher & Co., Huntington, WV (US)

( * ) Notice: Subject to any disclaimer, the term of this patent is extended or adjusted under 35 U.S.C. 154(b) by 0 days. days.

(21) Appl. No.: 15/301,667

(22) PCT Filed: Apr. 3, 2015

(86) PCT No.: PCT/US2015/024236

§ 371 (c)(1),
(2) Date: Oct. 3, 2016

(87) PCT Pub. No.: WO2015/153963

PCT Pub. Date: Oct. 8, 2015

(65) Prior Publication Data

US 2017/0183966 A1 Jun. 29, 2017

Related U.S. Application Data

(60) Provisional application No. 61/974,604, filed on Apr. 3, 2014.

(51) Int. Cl.

| | |
|---|---|
| ***E21D 20/00*** | (2006.01) |
| ***E21D 11/40*** | (2006.01) |
| ***E21B 7/02*** | (2006.01) |

(52) U.S. Cl.
CPC ..... *E21D 20/003* (2013.01); *E21B 7/02* (2013.01); *E21D 11/40* (2013.01); *E21D 20/006* (2013.01)

(58) Field of Classification Search
CPC ..... E21D 20/00; E21D 20/003; E21D 20/006; E21D 11/40; E21D 21/00; E21B 7/02; E21B 7/022; E21B 7/023; E21B 7/026
USPC ..... 405/259.1, 288; 175/57, 78, 79, 85, 122, 175/170, 195, 203; 173/164, 195; 248/654; 299/11, 12
See application file for complete search history.

(56) References Cited

U.S. PATENT DOCUMENTS

| | | | |
|---|---|---|---|
| 1,984,621 | A | 12/1934 | Babin et al. |
| 2,828,109 | A | 3/1958 | Dellner |
| 2,832,567 | A | 4/1958 | Fletcher |

(Continued)

*Primary Examiner* — Carib A Oquendo
(74) *Attorney, Agent, or Firm* — King & Schickli, PLLC

(57) ABSTRACT

A drilling apparatus including a drill is disclosed for use with a mine roof bolter. The apparatus includes a support adapted to rotate the drill about two different axes. The first axis may be a vertical axis and the second axis may be a horizontal axis. The drilling apparatus includes a mast for supporting the drill and allowing relative movement of the drill with respect to the mast. The drilling apparatus additionally includes an element for longitudinally moving the mast with respect to the support. The drilling apparatus may further include a mesh aligner for aligning the mesh with respect to the drill. A drill guide with a small footprint may also be included which is capable retracting within a housing to avoid interference with a face of the mine when positioning the drilling apparatus.

8 Claims, 13 Drawing Sheets

(56) References Cited

U.S. PATENT DOCUMENTS

| | | | | |
|---|---|---|---|---|
| 3,399,734 | A | 9/1968 | Folinsbee | |
| 3,470,969 | A * | 10/1969 | Arcangeli | E21B 7/022 173/194 |
| 3,645,343 | A | 2/1972 | Mays | |
| 3,749,454 | A | 7/1973 | Bailey et al. | |
| 4,076,337 | A | 2/1978 | Childress | |
| 4,190,119 | A | 2/1980 | Loftis et al. | |
| 4,229,124 | A * | 10/1980 | Frey | E21D 20/006 173/184 |
| 4,311,347 | A | 1/1982 | Cobb | |
| 4,438,984 | A | 3/1984 | Leppala | |
| 4,472,002 | A | 9/1984 | Beney et al. | |
| 4,703,811 | A | 11/1987 | Lam | |
| 4,972,911 | A | 11/1990 | Rajakallio | |
| 4,979,575 | A * | 12/1990 | Strom | E21B 7/022 173/1 |
| 5,114,279 | A | 5/1992 | Bjerngren et al. | |
| 6,135,674 | A | 10/2000 | Neilson | |
| 6,302,623 | B1 | 10/2001 | Nellson | |
| 6,736,225 | B2 | 5/2004 | Pierce | |
| 6,896,072 | B2 | 5/2005 | MacDonald | |
| 7,381,012 | B2 | 6/2008 | Hinshaw et al. | |
| 7,407,344 | B2 | 8/2008 | Hinshaw et al. | |
| 7,428,935 | B2 | 9/2008 | Hinshaw et al. | |
| 7,428,936 | B2 | 9/2008 | Hinshaw et al. | |
| 7,428,937 | B2 | 9/2008 | Hinshaw et al. | |
| 7,438,141 | B2 | 10/2008 | Hinshaw et al. | |
| 7,600,583 | B2 | 10/2009 | Hinshaw et al. | |
| 7,607,866 | B2 | 10/2009 | Eddowes et al. | |
| 7,617,884 | B2 | 11/2009 | Rubie | |
| 7,704,018 | B2 | 4/2010 | Hinshaw et al. | |
| 7,845,398 | B2 | 12/2010 | Wood | |
| 8,342,267 | B1 | 1/2013 | Hinshaw et al. | |
| 2003/0205411 | A1 | 11/2003 | Pierce | |
| 2004/0178004 | A1 * | 9/2004 | MacDonald | E21B 7/024 175/162 |
| 2006/0231267 | A1 | 10/2006 | Wood | |
| 2006/0272862 | A1 | 12/2006 | Hinshaw et al. | |
| 2006/0283634 | A1 | 12/2006 | Hinshaw et al. | |
| 2011/0270255 | A1 | 11/2011 | Smith | |
| 2014/0231137 | A1 | 8/2014 | Wilson et al. | |

* cited by examiner

DRILLING APPARATUS

This application claims priority to U.S. Provisional patent application 61/974,604, filed Apr. 3, 2014, the disclosure of which is incorporated herein by reference.

TECHNICAL FIELD

This disclosure relates to the mining arts and, more particularly, to a drilling apparatus, such as for use in forming a borehole in a face of a mine passage.

BACKGROUND

During underground mining, it is a requirement for purposes of safety as well as federal law to install support to the roof of a passage at various intervals. This is often done using a mining machine known in the vernacular as a "roof bolter." Typically, such a roof bolter is capable of both forming (drilling) boreholes and then installing roof anchors or "bolts" in the boreholes.

Bolters often include an elongated boom for raising and lowering an attached bolting module, which incorporates a drill for forming the borehole for receiving the bolt or anchor. Proper positioning of the drill feed mechanism (commonly called the feed or the drill mast) is critical for full utilization of the entire effective length of the drill steel. In many cases, if the positioning of the drill is proper, then a hole can be drilled with one drill steel. If optimal positioning cannot be reached, then the same task may require two or more different drill steels to drill the hole. Using multiple drill steels can require additional time and handling, which can increase the possibility of injury. Similar issues arise with installation of a bolt. Achieving a better position may result in a single pass installation versus a more time consuming, and possibly more dangerous two-pass installation. In the case of drilling and installation of a bolt, the difficulty can be magnified in tight quarters, such as in narrow seam mining.

Accordingly, a need is identified for a drilling mechanism that allows for a greater range of motion of the drill, that operates with such range of motion within a small space, and that allows for more efficient use of time and space in the drilling and bolting actions. This may include various aspects which allow the drilling mechanism access to a greater degree of the rib, the roof, and the face of the mine, as well as allowing the drill to operate with a more compact design to prevent certain aspects of the drill from interfering with overall operation.

SUMMARY OF THE INVENTION

This disclosure relates to the mining arts and, more particularly, to a drilling apparatus, such as for use in forming a borehole in a face of a mine passage.

In one embodiment, an apparatus is disclosed for use in connection with a drill for forming a borehole in a face of a mine passage, said apparatus comprising a support for supporting a drill, a first rotary actuator for rotating the drill support about a first axis, and a second rotary actuator for rotating the drill about a second axis.

The apparatus may include a mast supported by the support, the mast movably supporting the drill. In one aspect, the apparatus may further include means for moving the mast along a longitudinal axis of the mast independent of the first and second rotary actuators. The means for moving the mast may comprise a bracket for movably supporting the mast with respect to the support. The means for moving the mast may comprise a hydraulic cylinder for moving the mast with respect to the bracket.

In a further aspect, the apparatus may further include means for moving the drill independent of movement of the mast. The means for moving the drill may comprise a gear and chain actuated by a motor.

In any of the above aspects, the first axis may be a vertical axis. The second axis may be transverse to the first axis, such as, for example, a horizontal axis.

In any of these aspects, at least one of the first or second rotary actuators may be adapted to rotate approximately 180°. At least one of the first or second rotary actuators may be adapted to rotate at least 180°, and/or up to 270°.

In a further aspect, the apparatus may include an operator's station. The first and second rotary actuators may be adapted to take a neutral position with the drill facing upward from a base of the apparatus, such as may be useful in drilling the roof of the mine. In the neutral position, the first axis may be vertical, the second axis may be horizontal, and the drill may be positioned between mast and the operator's station.

In another embodiment of the invention of the present invention, an apparatus is disclosed for use in connection with a drill for forming a borehole in a face of a mine passage and applying a mesh to the face. The apparatus may comprise a support for supporting the drill and a mesh aligner supported by the support, the mesh aligner including at least one aligning element for positioning a portion of the mesh. The aligning element may comprise a channel for receiving the portion of the mesh. In one aspect, the mesh retainer may comprise a plurality of channels, each for receiving a portion of the mesh. The plurality of channels may be positioned so as to face the face of the mine passage during application of the mesh to the face.

In one aspect, the apparatus may further include an actuator for moving the support relative to the face, which in turn may move the mesh retainer relative to the face.

In any of these aspects, the apparatus may further include at least one connector for facilitating connection of the mesh to the mesh retainer. The at least one connector may include a plurality of anchors for receiving one or more retainers for securing the mesh in contact with the mesh aligner.

In a further embodiment of the present invention, a guide for a drilling element is disclosed. The guide may include a pair of jaws oriented in different planes and arranged for assuming an open condition and a closed condition for retaining the drilling element.

In an additional embodiment a guide for a drilling element is disclosed, said guide comprising a pair of jaws arranged for assuming an open condition and a closed condition for retaining the drilling element, at least one of the jaws including a follower, and an actuator including a cam for engaging the follower. The follower may comprise a slot formed in a body of the at least one of the jaws.

In another embodiment, a guide for a drilling element is disclosed which may comprise a pair of jaws arranged for assuming an open condition and a closed condition for retaining the drilling element, the jaws remaining connected to each other by a connector in the open condition and the closed condition. The connector may be adapted to retract in the open condition and extend in the closed condition.

Another embodiment of the present invention relates to a guide for a drilling element comprising a pair of jaws arranged for assuming an open condition and a closed condition for retaining the drilling element by moving about respective pivot points, a first jaw including a first receiver for receiving a portion of the drilling element, said first receiver opposite the pivot point of the first jaw, and a second jaw including a second receiver for receiving a portion of the drilling element, said second receiver opposite the pivot point of the second jaw. The first and second receivers may be generally C-shaped.

In still a further embodiment, a guide for use in connection with a drilling element is disclosed, said guide comprising a pair of jaws arranged for assuming an open condition and a closed condition for retaining the drilling element and a housing for retaining the pair of jaws in the open condition, wherein the pair of jaws are at least partially external to the housing in the closed condition.

In any of the above embodiments of a guide for a drilling element, in the closed condition, the pair of jaws may be adapted to take both a guide position for allowing at least one of rotational and longitudinal movement of the drilling element, and a clamped position for hindering at least one of rotational and longitudinal movement of the drilling element.

In any of the above embodiments of a guide for a drilling element, the guide may further include an actuator for moving the pair of jaws between the open condition and the closed condition. The actuator may comprise a cylinder adapted to move in a direction transverse to a plane of at least one of the jaws.

In any of the above embodiments of a guide for a drilling element, the guide may include a plate for pivotally mounting said pair of jaws. In such a case, the guide may further include an extension element associated with the plate, said extension element adapted to retract toward the plate in the open condition and extend away from the plate in the closed condition. The extension element may be at least partially housed within the plate in the open condition.

DETAILED DESCRIPTION

Referring now to the various figures, this disclosure relates primarily to a drilling apparatus 10 for use in a drilling or bolting machine, or "bolter." This bolter is used in connection with the installation of support in a face of a mine passage. Specifically, such a bolter is adapted for forming a borehole in the face, and then subsequently installing an anchor (typically an elongated piece of rebar called a "roof bolt") in the borehole. The drilling apparatus 10 typically is adapted for use in connection with a drilling element, or "drill steel," prior to and during the process of forming the borehole.

Figure 1:
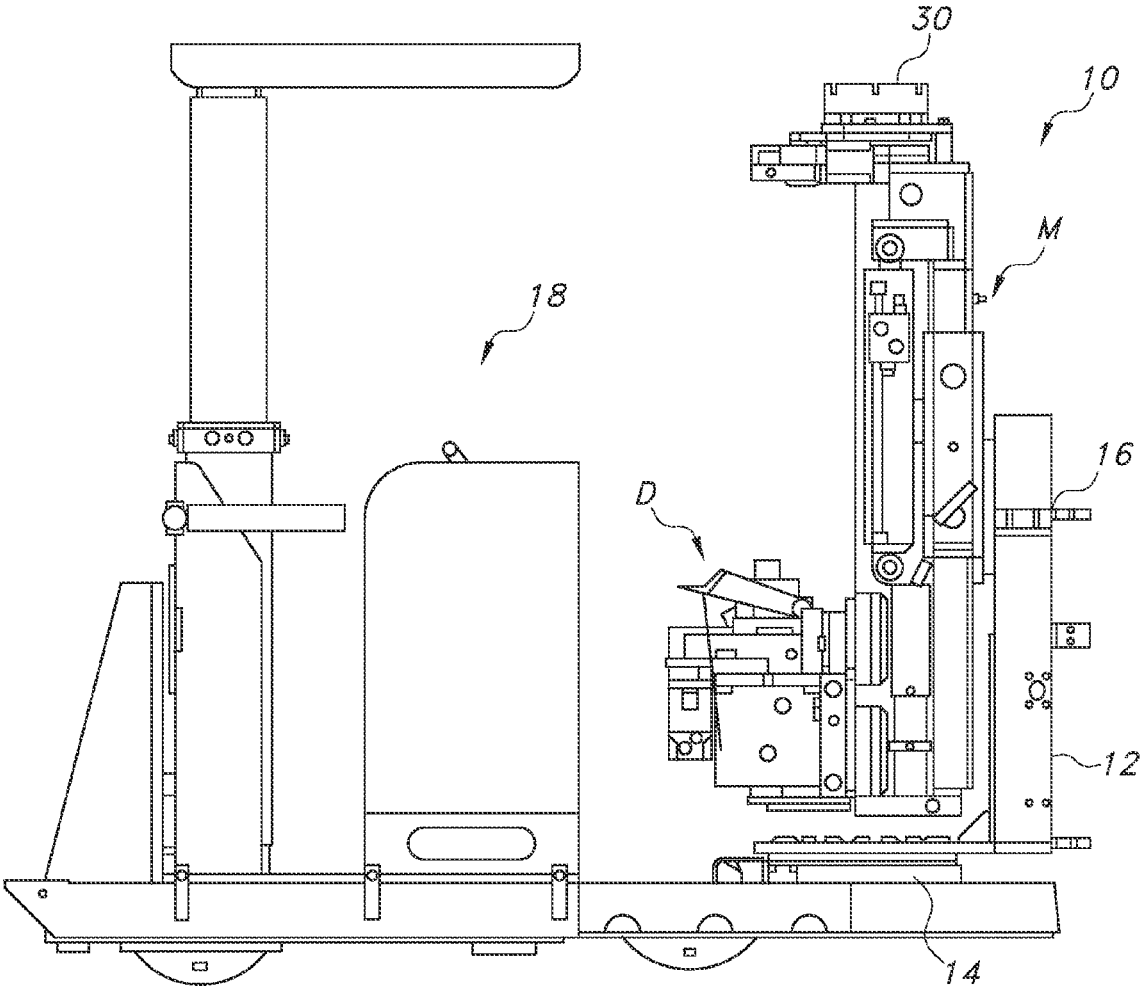
FIG. 1 is a side elevational view of a roof bolter including a drilling apparatus according to the present invention.

As shown in FIG. 1, the bolter typically includes a mechanism for advancing and retracting a drill D forming part of the drilling apparatus 10 toward and away from the case. This mechanism may comprise a mast M. The mast M in this embodiment is connected to a support 12 that allows for a significantly higher degree of movement for the drill. Specifically, the support 12 comprises independent first and second rotary actuators 14, 16 that allow for the drill mast M to rotate about a first axis generally parallel to an operator on an associated base, and to rotate about a second axis generally transverse to the operator on the associated base. For example, the first axis may be a vertical axis, generally parallel to the operator standing in an upright position on an operator's station 18, as illustrated in FIG. 1, and the second axis may comprise a horizontal axis transverse to said vertical axis.

Figure 2:
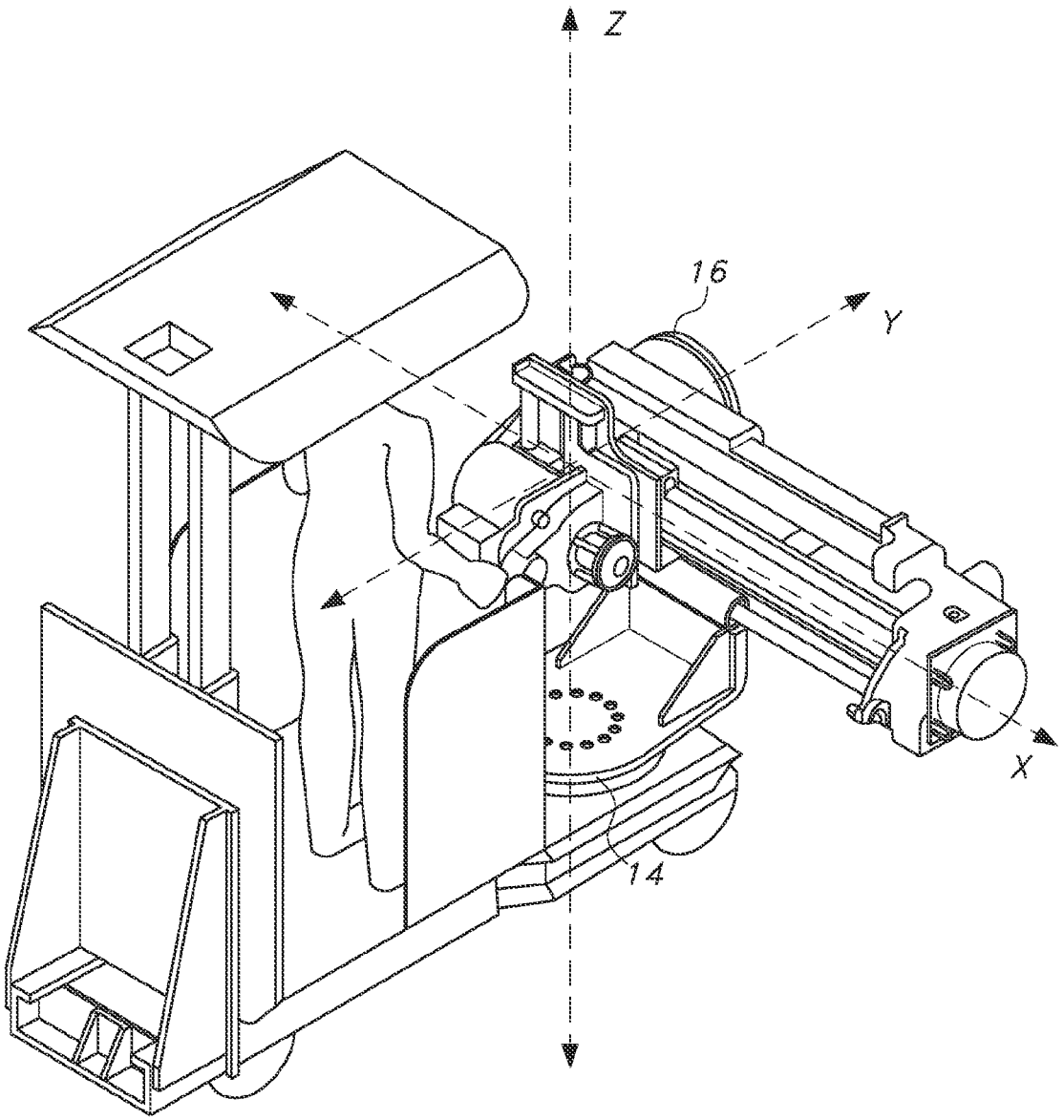
FIG. 2 is a isometric view of the bolter of FIG. 1.
Figure 3C:
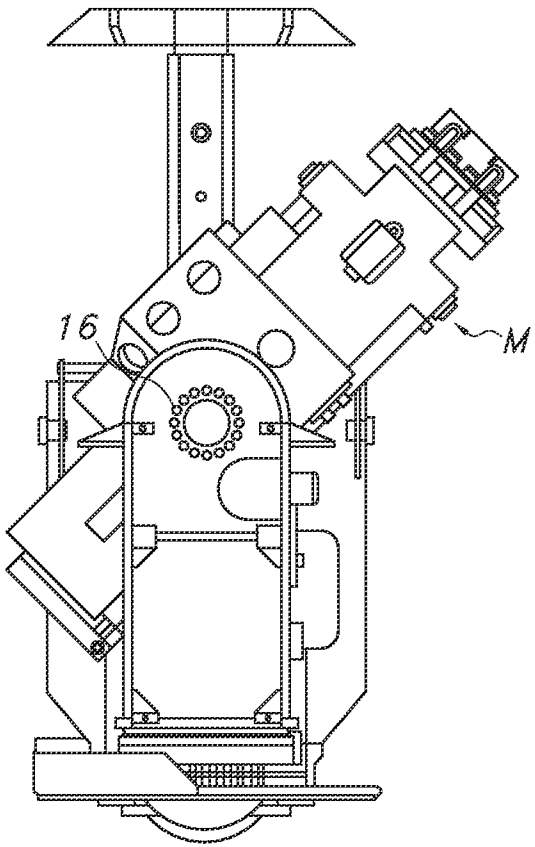
FIG. 3*a*, FIG. 3*b*, and FIG. 3*c* are front elevational views of the roof bolter of FIG. 1.
Figure 3B:
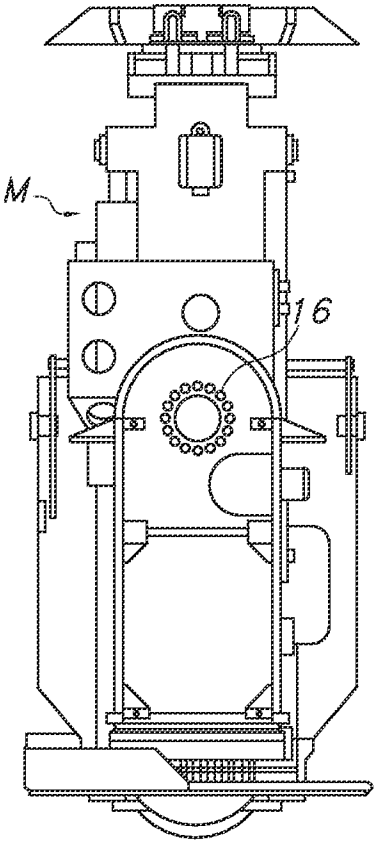
Figure 3A:
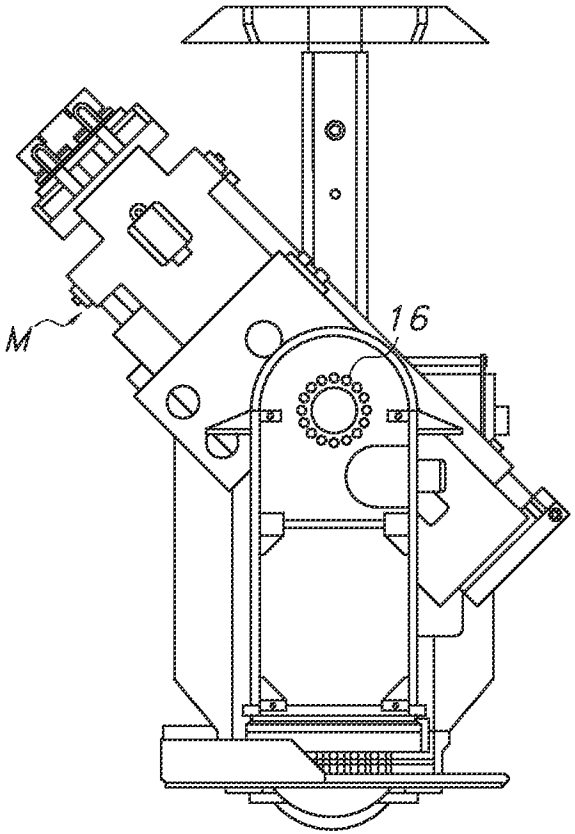

With reference to FIG. 2, the rotation of the independent first and second rotary actuators 14, 16 can be more clearly seen. The first rotary actuator 14 may allow for rotation about a first axis Z, while the second rotary actuator 16 may allow for rotation about a second axis Y. As illustrated in FIG. 2, the Y axis is parallel to a longitudinal direction of the bolting machine from front to back, but as can be appreciated, with the rotation of the first rotary actuator 14, the second axis Y about which the second rotary actuator 16 rotates may also rotate. In one aspect the second axis Y may remain perpendicular to the first axis Z. Rotation of the second rotary actuator 16 can be further seen in FIGS. 3*a*-3*c*, which show the mast M rotated to a first side, in a vertical position, and to a second side, respectively.

Figure 4:
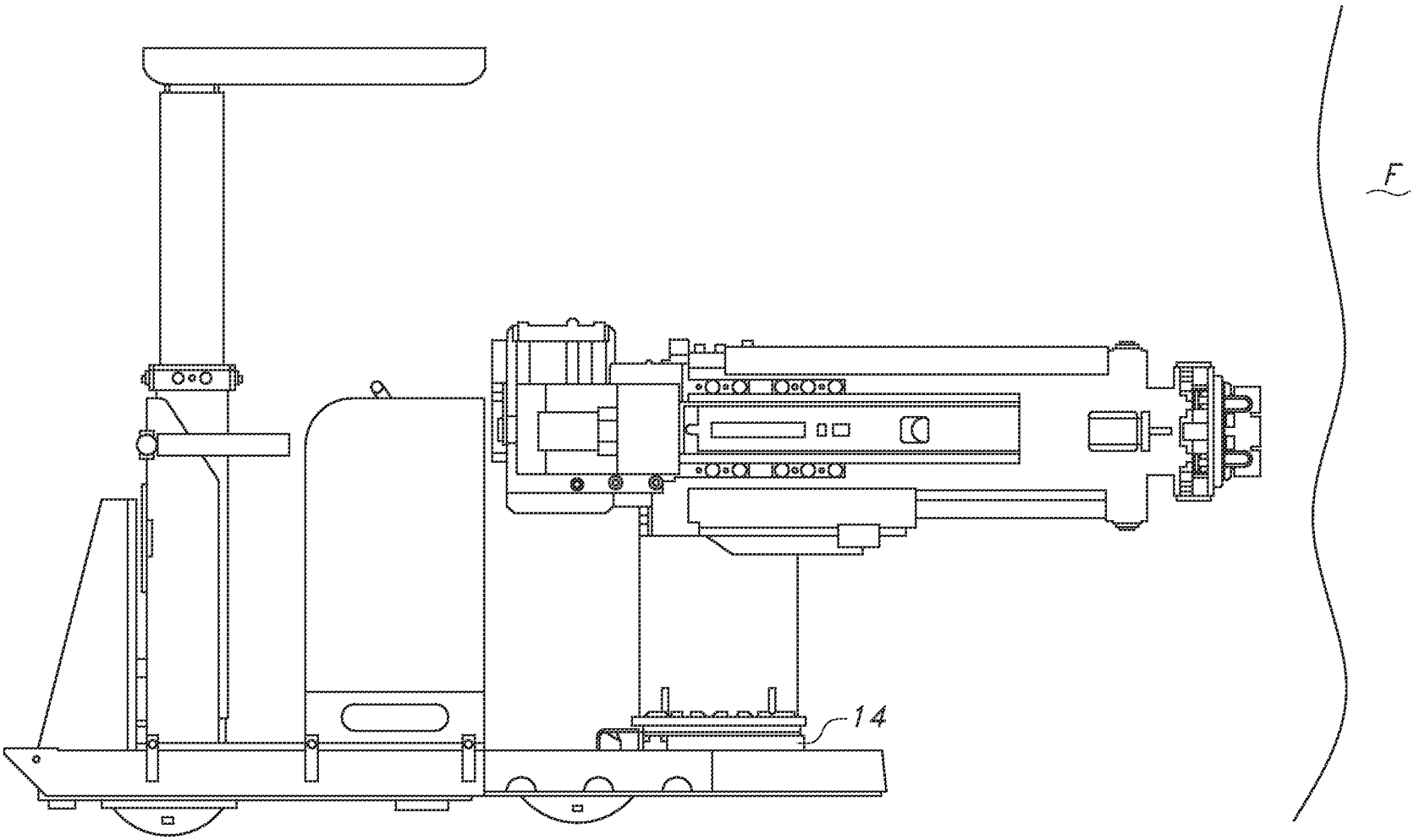
FIG. 4 is a further side elevational view of the bolter of FIG. 1 in a configuration with the drill facing forward.

One or both of the first and second rotary actuators 14, 16, may be adapted to allow for approximately 180° rotation of the mast M about its respective axis. In one embodiment, one or both of the first and second rotary actuators 14, 16 may be adapted to allow for approximately 270° rotation of the mast M about the respective rotary actuator's axis. The combination of the ability to rotate the mast M about the first and second axes allows for access to drill and/or bolt throughout the majority of the front quadrant of a sphere in front of the bolting machine. For example, as can be seen in FIG. 4, a 90° rotation of both the first and second rotary actuators 14,16 from their respective positions in FIG. 1 results in the mast M having the ability of facing the face F of the mine shaft in front of the bolter.

The bolter may also be equipped with a mechanism for allowing the mast M to move and/or extend and retract along its axis. For example, the mast M may be adapted to move and/or extend and retract along a third axis X, as illustrated in FIG. 2.

Figure 5:
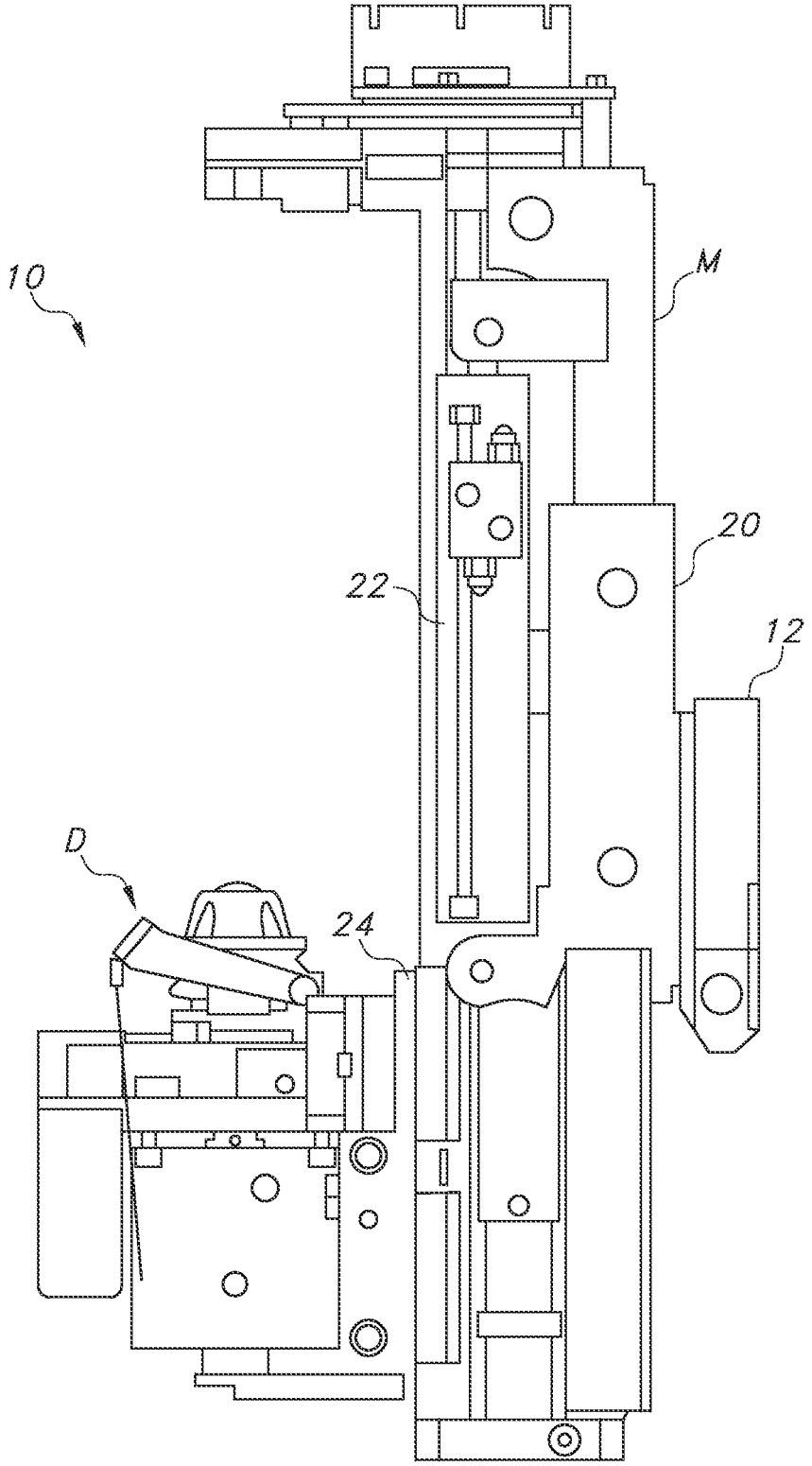
FIG. 5 is a side elevational view of the drilling apparatus of the present invention.

With reference to FIG. 5, the drilling apparatus 10 is illustrated with a bracket 20, which may be fixed with respect to the support 12, said bracket for supporting the mast M. The mast M may be allowed to move with respect to the bracket, such as along a longitudinal axis X of the mast. The drilling apparatus 10 may include means for moving the mast M along the longitudinal axis X, such as a hydraulic cylinder 22. In alternate embodiments, the means for moving the mast may include a chain feed, chain and gears or sprockets, and/or any other device capable of inducing longitudinal movement. Actuation of the hydraulic cylinder 22 may allow for further range of motion of the mast M during the drilling and bolting processes.

As can further be seen in FIG. 5, the drilling apparatus 10 may include a second extension means 24 for moving the drill D parallel to the longitudinal axis X, independent of the movement of the mast M. As illustrated, the second extension means 24 includes a chain and cylinder, but may comprise any device capable of inducing longitudinal movement of the drill D independent of the mast M, such as a hydraulic cylinder, or chain and gear/sprockets.

Figure 6A:
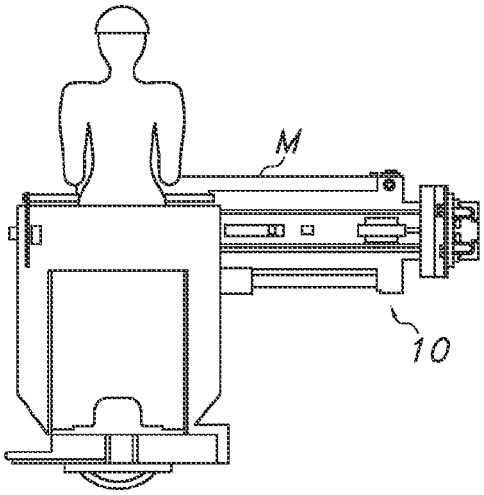
FIG. 6*a*, FIG. 6*b*, and FIG. 6*c* are rear elevational views of the drilling apparatus of the present invention.
Figure 6B:
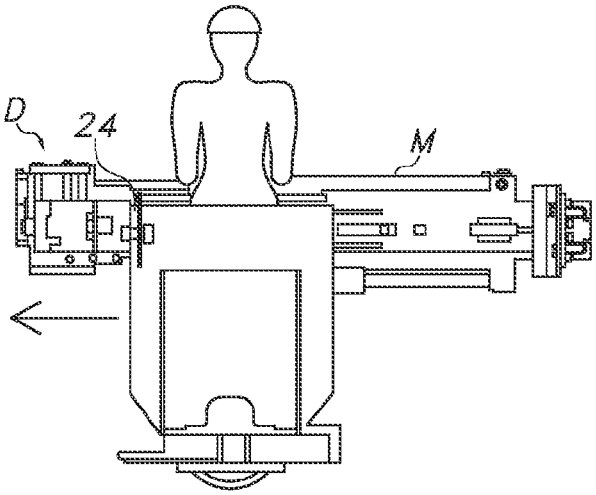
Figure 6C:
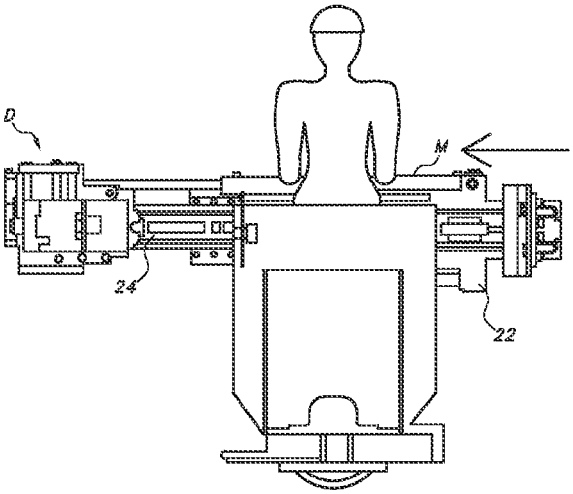

The combination of the first and second rotary actuators 14,16 as well as the above-described means for longitudinal movement of the mast M along its axis may further aid in positioning of the drilling apparatus 10, especially in tight quarters. With reference to FIGS. 6*a*-6*c*, the combined rotary and extension/retraction movements are illustrated in the context of drilling and/or bolting. As illustrated in FIG. 6*a*, the drilling apparatus 10 has been rotated by the second rotary actuator 16 to face a right side. FIG. 6*b* illustrates the second extension means 24 causing the drill D to be extended along the axis X of the mast M, such as for loading a drill steel and preparing for drilling. As can be seen between FIGS. 6*a* and 6*b*, the movement of the drill D due to the actuation of the second extension means 24 may be independent of any movement of the mast M, which has remained stationary in the illustrated embodiment.

With further reference to FIG. 6*c*, the cylinder 22 may be actuated to as to move the mast M with respect to the bracket 20 along or parallel to the axis X of the mast. This allows independent positioning of the end of the mast M opposite the drill D. As shown in FIG. 6*c*, the end of the mast M opposite the drill D is located closer to the operator than would be possible if the mast M were fixed with respect to the support 12 and bracket 20. Positioning the mast M in such a position may be quite useful in drilling or bolting into the rib of a mine passage if the bolter must be located immediately adjacent to the rib. For example, if the bolter must be located closer to the rib than would be allowed by the position of the mast M as illustrated in FIG. 6*a*, the actuation of the cylinder 22 allows for the mast M to retract along its axis X, thereby allowing drilling in a position otherwise unavailable.

In another aspect of the invention, as can perhaps be best seen in FIGS. 2 and 6*a*-6*c*, the drilling apparatus 10 and the support 12 may be arranged such that access to the drill D is facing the operator or the operator's station 18 in a majority of positions of the mast M. For example, as the mast rotates via the second rotary actuator 16 (with the first rotary actuator 14 remaining in an initial neutral position as illustrated in FIG. 2) so as to allow the operator to drill a rib on either side of the bolter or the roof above the bolter, the drill D may face the operator's station 18. This allows the operator easy access to the drill D, such as for the purpose of inserting drilling steels, bolts, or the like. The mast M is generally opposite the operator when positioned in the operator's station 18. This arrangement allows for easier and safer loading and operation of the drill D.

Figure 7A:
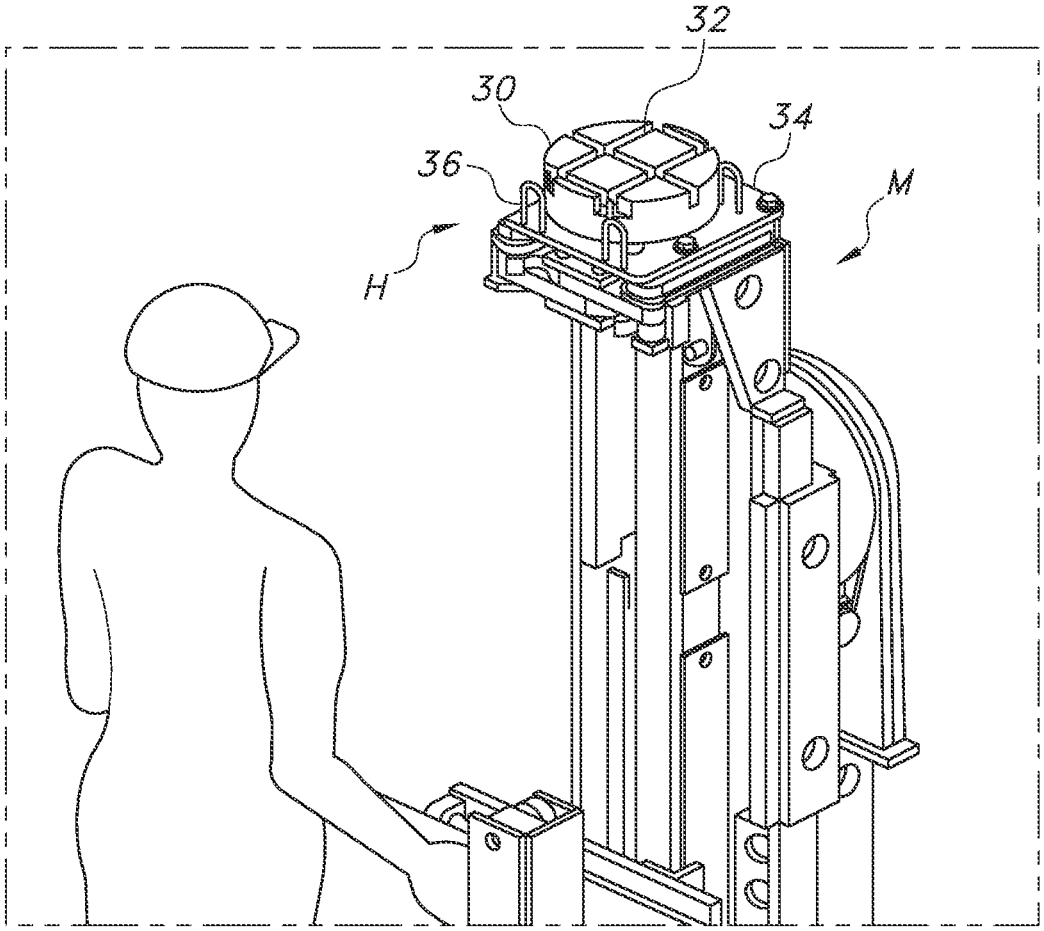
FIG. 7*a* is an isometric view of the mesh aligner of the present invention.
Figure 7B:
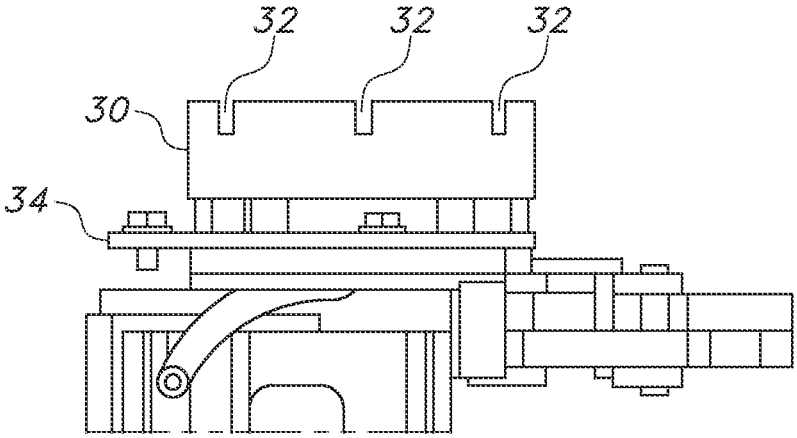
FIG. 7*b* is a side elevational view of the mesh aligner of FIG. 7*a;*

With reference to FIGS. 7*a* and 7*b*, a further aspect of this disclosure pertains to a mesh aligner 30, which may be associated with the upper portion of the mast M. This mesh aligner 30 may include a plurality of aligning elements, such as channels 32 (which are shown as being orthogonal), adapted for positioning individual members forming a mesh to be applied to a surface, such as a face of a mine passage. In the case of channels 32, the individual members forming the mesh may be received at least partially within the channels to secure the mesh in a desired position. In this manner, proper alignment of the mesh is assured as the drill D is used to connect it to the face, such as by using anchors or bolts. The mesh aligner 30 and/or the channels 32 thereon may be positioned in a plane orthogonal to the longitudinal axis X of the mast M. For example, the mesh aligner 30 may be mounted on a plate 34 at the top of the mast M.

Connectors, such as frangible ties (not shown), may optionally be used to hold the mesh in place on the aligner 30. For example, anchors 36 may be provided adjacent the aligner 30 for attaching said connectors and mesh to the mast M. As illustrated in FIG. 7*a*, four anchors 36 may be provided, such as surrounding the mesh aligner 30, so as to securely and evenly connect the mesh (not shown) to the aligner 30.

In practice, the operator may position the mast M in the appropriately angled position for drilling and/or bolting, and the mesh may be attached to the aligner 30 for attachment to a face of the mine. For example, in order to attach mesh to the roof of the mine above the operator, the mast M may be positioned in an upright position, as illustrated in FIGS. 1 and 7*a*. If necessary, the cylinder 22 may be actuated to lower the mast M parallel to the longitudinal axis X of the mast M, so as to give the operator access to the mesh aligner 30. The mesh (not shown) may be aligned with the aligning elements, such as channels 32, and may be secured in position with respect to the mast M and/or mesh aligner 30, such as via attachment to anchors 36. If necessary, the drill D may be loaded, such as with a drill steel or bolt. The cylinder 22 may be actuated so as to raise the mast M (and therefore the mesh) to the roof and position the mesh to be attached thereto. The operator may then actuate the extension means 24 in order to move the drill D parallel to the longitudinal axis X of the mast toward the roof, thereby attaching the mesh to the roof with the bolt. This process may be used to apply mesh to any face of the mine (e.g. the rib or face) by aligning the mast and drill with the appropriate face.

Figure 8A:
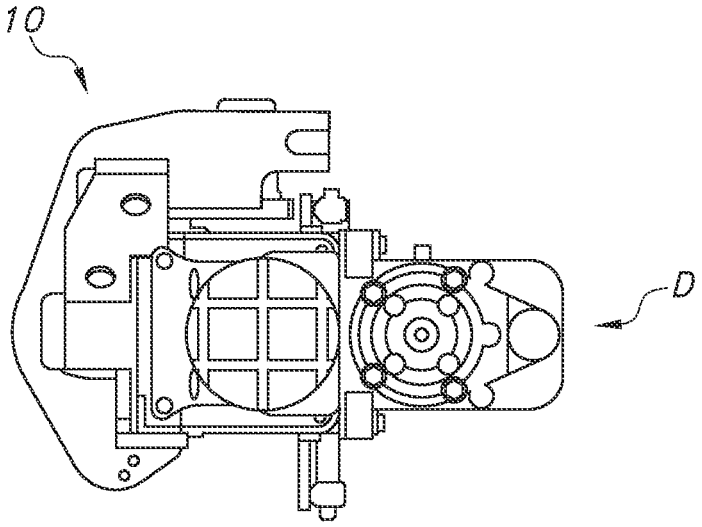
FIG. 8*a*, FIG. 8*b*, and FIG. 8*c* are top plan views of the drilling apparatus of the present invention including a guide for a drilling element.
Figure 8B:
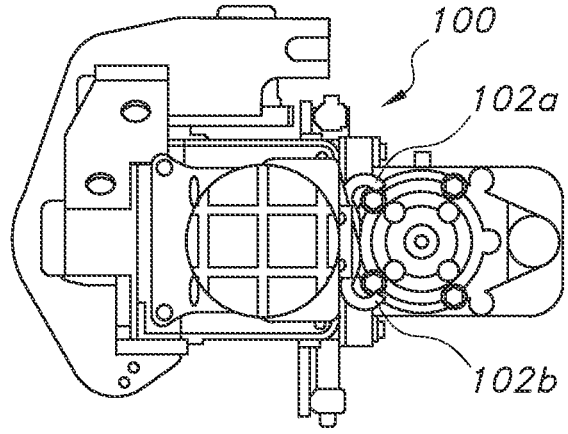
Figure 8C:
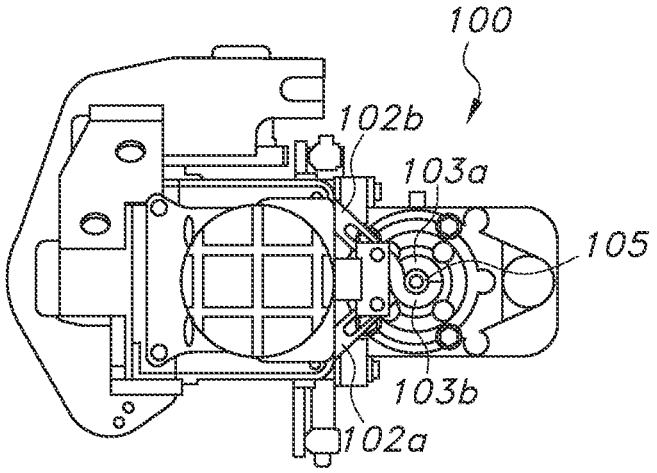

Another embodiment of an improved drill guide 100 is shown in FIGS. 8*a*-11*b*. The drill guide of this embodiment includes a pair of jaws 102*a*, 102*b* mounted for movement toward and away from each other in a plane generally transverse to the direction of feed of the drill D or the longitudinal axis X of the mast M. The jaws 102*a*, 102*b* may be mounted to a support element 104 for relative pivoting movement about pivot points P (see FIGS. 10*a* and 10*b*). The support element 104 may be located near an end of the mast M opposite the drill D, such as is illustrated in FIGS. 8*a*-8*c*, wherein the support element 104 may be adjacent the mesh aligner 30. FIG. 8*a* illustrates the jaws 102*a*, 102*b* in a fully retracted position, FIG. 8*b* illustrates the jaws 102*a*, 102*b* in a partially extended position, and FIG. 8*c* illustrates the jaws 102*a*, 102*b* in a fully extended position, such that the operative ends 103*a*, 103*b* create an opening 105 which aligns with a drill steel or bolt loaded in the drill D.

In one aspect, the jaws 102*a*, 102*b* may lie in different planes in the direction aligned with the pivot axis (here, the vertical direction, but of course this may change depending on the orientation of the associated mast M). The different planes in which the jaws 102*a*, 102*b* lie may be parallel to one another.

Figure 9:
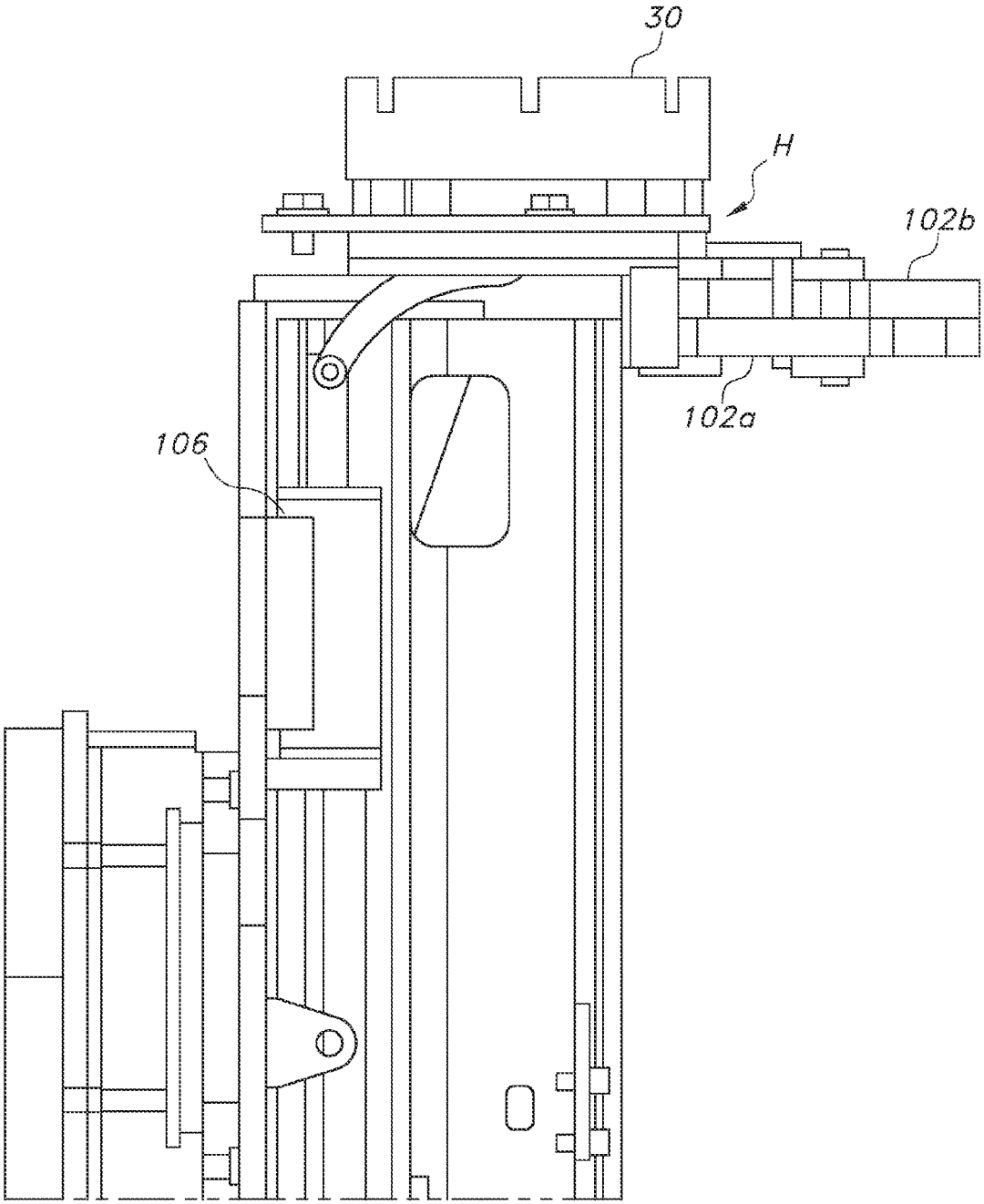
FIG. 9 is a side elevational view of the drilling apparatus including the guide for a drilling element.

As can be seen in FIG. 9, an actuator 106 is provided for actuating the jaws 102*a*, 102*b* to move between a first, open position (FIGS. 10*a* and 11*a*) and a second, closed position (FIGS. 10*b*, 11*b*) for guiding or gripping an object such as a drill steel or bolt. The actuator 106 in the illustrated embodiment comprises a linear actuator, such as a hydraulic cylinder, which is provided spaced apart from the jaws 102*a*, 102*b* and support 104. As illustrated, the cylinder of actuator 106 lies along an axis generally transverse to the planes in which the jaws 102*a*, 102*b* lie. For example, the axis of the cylinder of actuator 106 may lie parallel to the longitudinal axis X of the mast M. This advantageously allows for the fluid supply lines to be located away from the drill guide 100, mast, and other moving components.

Figure 10A:
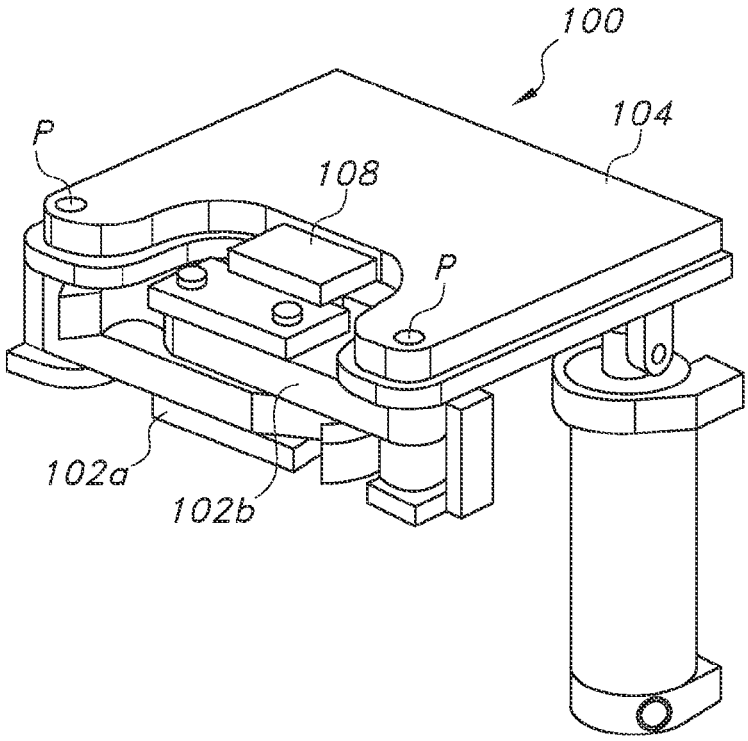
FIG. 10*a* and FIG. 10*b* are isometric views of the guide for a drilling element in the open and closed conditions, respectively.
Figure 10B:
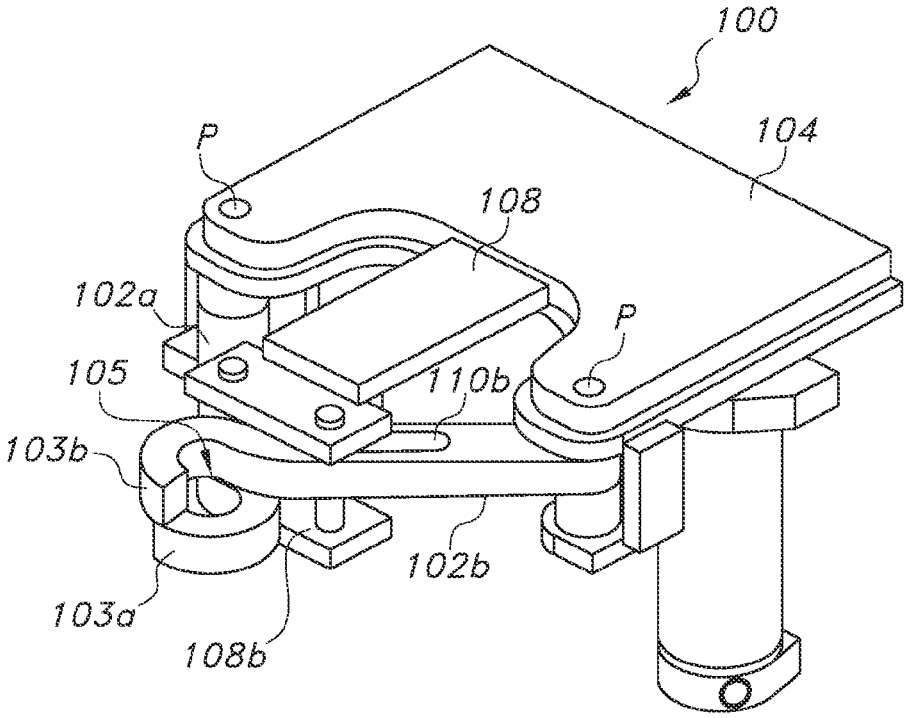
Figure 11A:
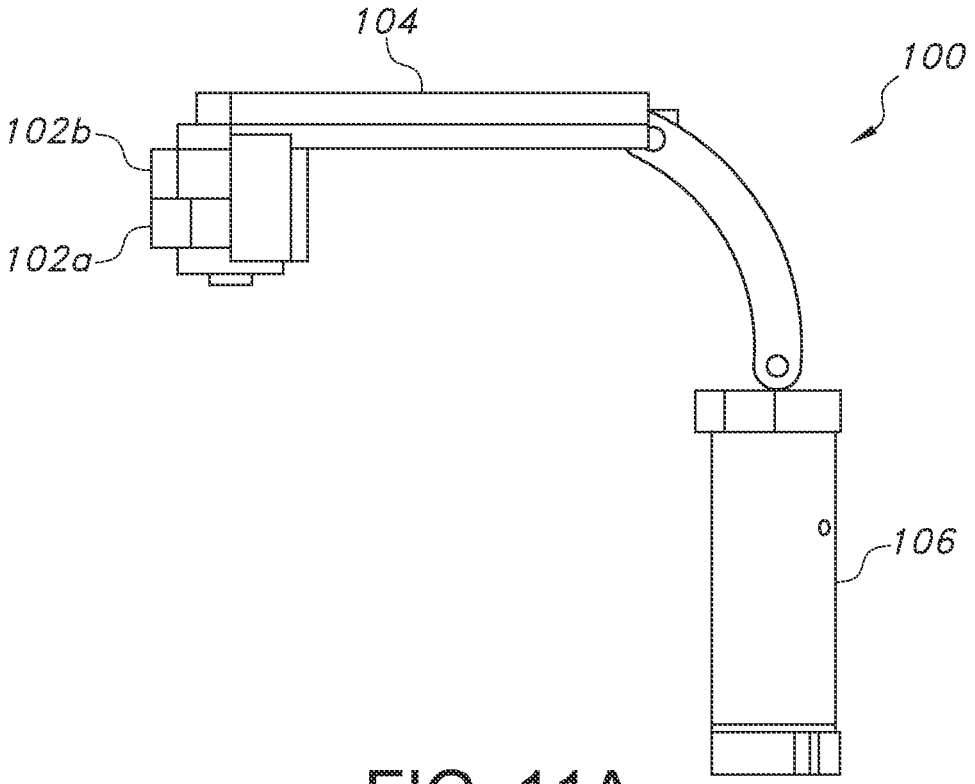
FIG. 11*a* and FIG. 11*b* are side elevational views of the guide of FIGS. 10*a* and 10*b;*
Figure 11B:
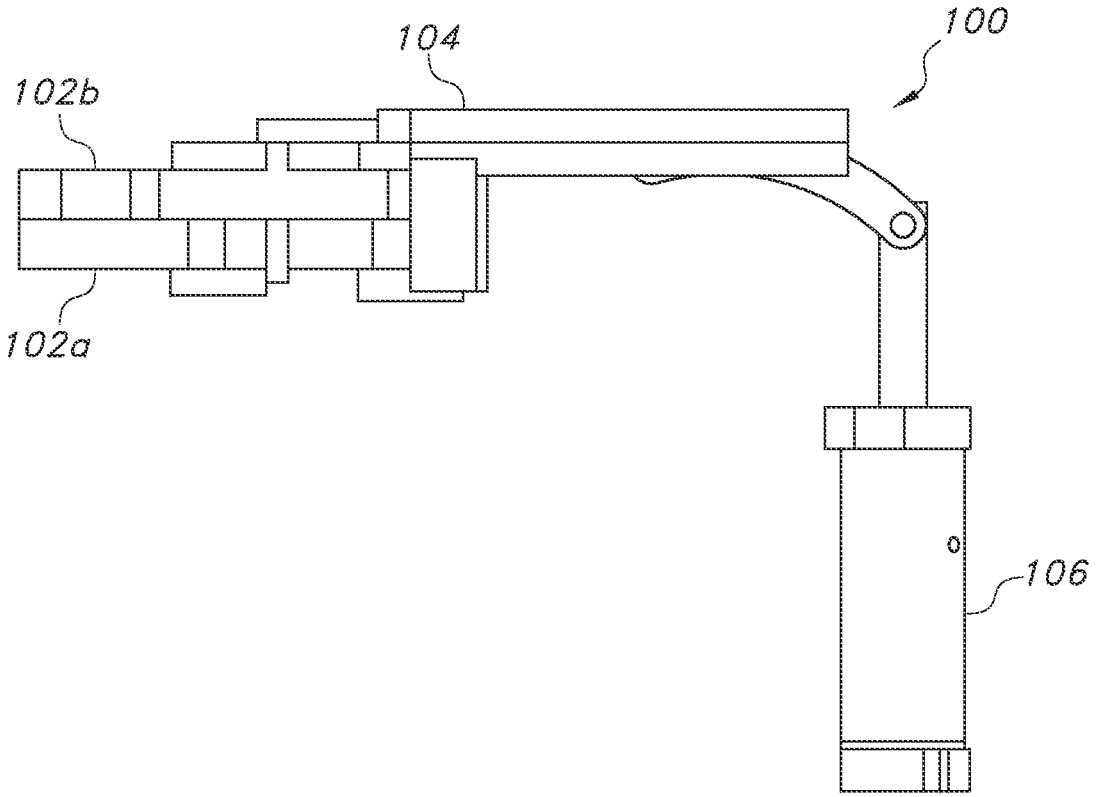

As can be appreciated from the Figures, the arrangement is such that the jaws 102*a*, 102*b* are fully retracted in the non-actuated condition. Actuating the actuator 106 causes a member 108 to advance from a stowed position, which may be partially covered by the support 104, and extend the operative ends 103*a*, 103*b* of the jaws 102*a*, 102*b* from the retracted position as the result of the linkage provided. Specifically, the member 108 supports cams 108*a*, 108*b*, that extend within corresponding followers 110*a*, 110*b* in the arms of the jaws 102*a*, 102*b*. The reverse movement causes the retraction. As can thus be appreciated from FIGS. 10*a* and 11*a*, an extremely low profile arrangement is provided with a small footprint. For example, in a retracted position, the jaws 102*a*, 102*b* may be parallel to one another along a longitudinal axis thereof. The retracted jaws 102*a*, 102*b* may be removed from a space between the drill D and the face of the mine to be drilled. As illustrated in FIG. 7*a*, the retracted jaws 102*a*, 102*b* may be fully contained within a housing H so as to avoid interference with the drill D and any face of a mine with which the drilling apparatus 10 may be used. As shown in FIGS. 10*b*, and 11*b*, in the extended position, the longitudinal axes of each of jaws 102*a*, 102*b* may be other than parallel to one another, such as being non-intersecting and/or divergent. In this extended position, the jaws may extend beyond the housing H in order to interact with a drill steel, bolt, or the like.

Figure 12:
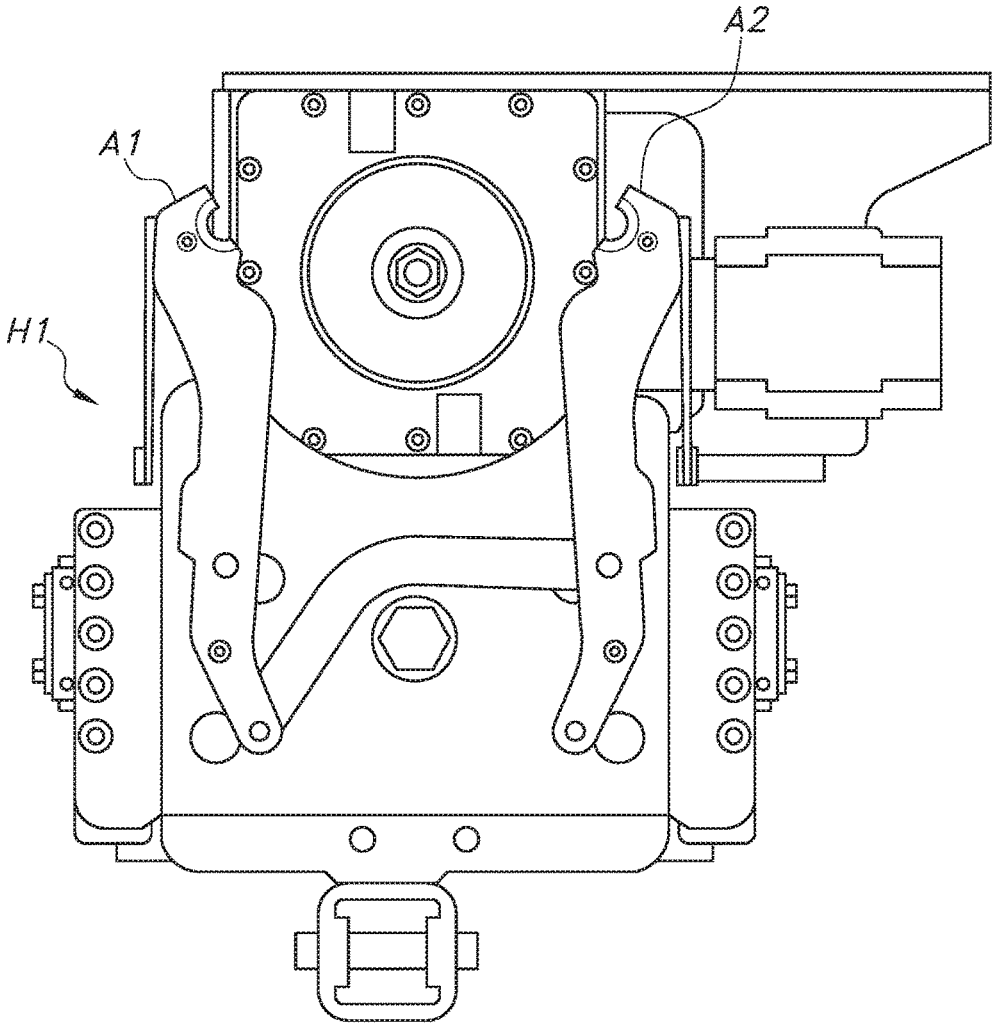
FIG. 12 is a top plan view of a prior art guide for a drilling element.

This arrangement can offer significant advantages over typical drill guides which are unable to take a retracted state as is the case with the jaws 102*a*, 102*b* of the present invention. For example, a typical drill guide as illustrated in FIG. 12 includes arms A1, A2, which may come together to form a guide for a drill steel or bolt, but which simply open and remain external to a housing H1. Allowing arms A1, A2 to remain exposed creates the potential for said arms A1, A2 to interfere with drill usage, as the arms may contact portions of the mine face, especially in the case of uneven rock conditions associated with the face of the mine. Specifically, standard drill guide arms A1, A2 may contact a face of the mine during drilling, thereby preventing the drill from being positioned as close to the face as if the arms were retractable, such as jaws 102*a*, 102*b* of the present invention.

In a further aspect of the present invention, the jaws 102*a*, 102*b* of the improved drill guide 100 may be adapted to guide and/or clamp an item such as a drill steel or bolt. For example, a controller (not pictured) may be provided for extending the jaws 102*a*, 102*b* to a guide position which forms opening 105 which is large enough to allow for a drill steel or bolt to rotate therein. This allows for proper positioning of the drill steel or bolt, while not hindering or preventing the rotational or longitudinal movement of said drill steel or bolt therein. Additionally, the jaws 102*a*, 102*b* may be adapted to be positioned in a clamping position, which forms an opening 105 small enough to clamp the drill steel or bolt, thereby hindering or preventing rotational and/or longitudinal movement therein.

Figure 13C:
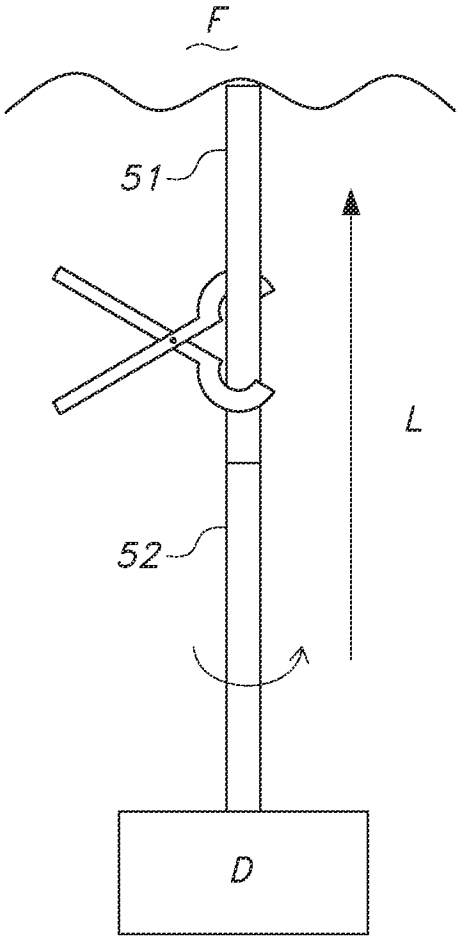
FIG. 13*a*, FIG. 13*b*, and FIG. 13*c* are schematic views of use of the guide for a drilling element of the present invention.
Figure 13B:
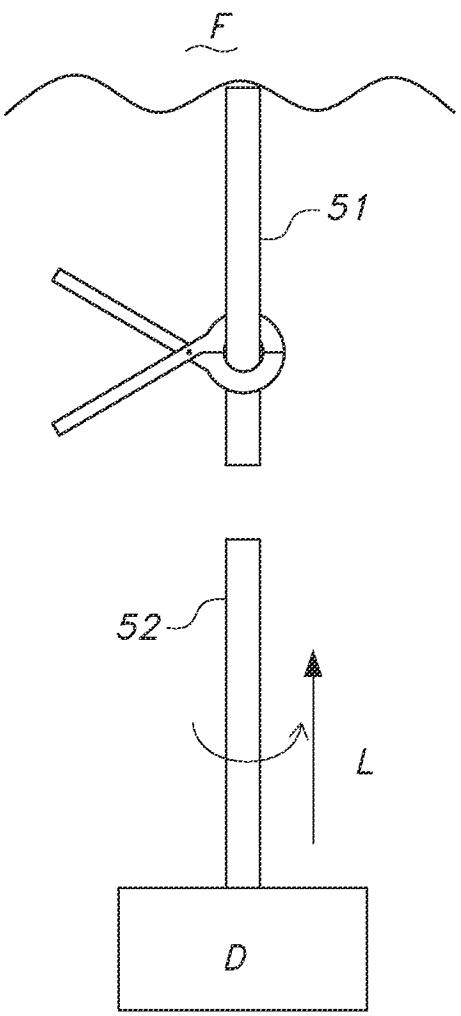
Figure 13A:
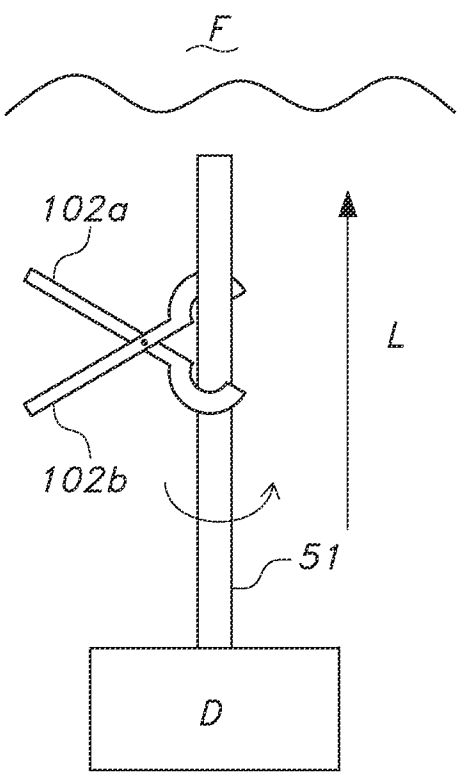

As illustrated in FIGS. 13*a*-13*c*, this dual ability to both guide and clamp may be useful in a drilling scenario in which two or more drill steel pieces must be used together. This may be particularly important in the case of hard rock mining, such as in the case of mining for precious minerals or other vein deposits. For example, hard rock mining often occurs in small spaces, such as in the context of a narrow vein, and may require two or more drill steel pieces S1, S2 being attached to one another during a drilling exercise. As illustrated in FIG. 13*a*, the jaws 102*a*, 102*b* may be positioned in the guide position around a first drill steel S1, allowing the drill D to rotate the first drill steel S1 and advance said first drill steel S1 in a longitudinal direction L into the face F of the mine. As shown in FIG. 13*b*, once the first drill steel S1 has been advanced to a first distance within the face F, the jaws 102*a*, 102*b* may be actuated to the clamp position, thereby hindering or preventing rotational movement of the first drill steel S1. The second drill steel S2 may then be attached to the stationary drill steel S1, such as by being loaded into the drill D and rotated to attach the second drill steel S2 to the first drill steel S1, while the first drill steel S1 remains stationary. After the first and second drill steels S1, S2 have been connected, the jaws 102*a*, 102*b* may be actuated to the guide position, thereby allowing the drill D to impart rotational and longitudinal movement to both the first and second drill steels S1, S2, and advance both drill steels into the face F.

As illustrated, the connection between the first and second drill steels S1, S2 is accomplished via a rotational motion, such as screwing one threaded connection to another. Nevertheless, any other manner of attachment is contemplated in the invention herein, for example via a slip-together connection (e.g. a hex connection), a locking connection (e.g. a tri-lobe connection), or the like. In any case, the ability of the jaws 102*a*, 102*b* to clamp the first drill steel S1 allows for an operator to stabilize the first drill steel S1 during connection.

The foregoing descriptions of various embodiments are provided for purposes of illustration, and are not intended to be exhaustive or limiting. Modifications or variations are also possible in light of the above teachings. The embodiments described above were chosen to provide the best application to thereby enable one of ordinary skill in the art to utilize the disclosed inventions in various embodiments and with various modifications as are suited to the particular use contemplated. All such modifications and variations are within the scope of the invention.

The invention claimed is:

1. An apparatus for use in connection with a drill for forming a borehole in a face of a mine passage, comprising:

a support for supporting the drill;

a first rotary actuator for rotating the drill support about a first axis;

a second rotary actuator for rotating the drill about a second axis; and a mast supported by the support and having upright position, the mast including means for moving the drill along a longitudinal axis of the mast independent of the movement of the first and second rotary actuators;

an operator's station, wherein the first and second rotary actuators are adapted to take a neutral position with a drilling axis extending upward from a base of the apparatus, and wherein in the neutral position, the first axis is vertical, the second axis is horizontal, and the drill is positioned between the mast in the upright position and the operator's station.

2. The apparatus of claim 1, wherein the first axis is aligned with a drilling axis of the drill.

3. The apparatus of claim 2, wherein the second axis intersects the first axis.

4. The apparatus of claim 1, wherein at least one of the first and second rotary actuators is adapted to rotate at least 180°.

5. The apparatus of claim 1, wherein the first rotary actuator provides the drill support with a range of motion about the first axis of at least 180 degrees.

6. The apparatus of claim 5, wherein the second rotary actuator provides the drill with a range of motion about the second axis of at least 180 degrees.

7. The apparatus of claim 1, wherein the first rotary actuator provides the drill support with a range of motion about the first axis of approximately 270 degrees.

8. The apparatus of claim 1, wherein the second rotary actuator provides the drill with a range of motion about the second axis of approximately 270 degrees.

* * * * *